US007438292B1

(12) United States Patent
Brandt

(10) Patent No.: US 7,438,292 B1
(45) Date of Patent: Oct. 21, 2008

(54) MULTI-GAME PLAYING SURFACE AND ASSOCIATED METHODS

(76) Inventor: Robert Brandt, 9507 Hexham, Spring, TX (US) 77379

( * ) Notice: Subject to any disclaimer, the term of this patent is extended or adjusted under 35 U.S.C. 154(b) by 22 days.

(21) Appl. No.: 11/544,313

(22) Filed: Oct. 7, 2006

Related U.S. Application Data

(60) Provisional application No. 60/804,003, filed on Jun. 6, 2006.

(51) Int. Cl.
*A63F 3/00* (2006.01)

(52) U.S. Cl. ..... 273/242; 273/271

(58) Field of Classification Search ..... 273/242, 273/243, 271
See application file for complete search history.

(56) References Cited

U.S. PATENT DOCUMENTS 4,092,029 A * 5/1978 Jones ..... 273/271
4,139,199 A 2/1979 Drummond
4,335,879 A 6/1982 Wisker
4,684,136 A 8/1987 Turner
5,655,773 A 8/1997 Marks
6,089,871 A * 7/2000 Jaffe ..... 434/209
6,273,422 B1 * 8/2001 McGahan ..... 273/241
6,419,231 B1 7/2002 Rivera

* cited by examiner

*Primary Examiner*—Vishu K. Mendiratta

(57) ABSTRACT

A board game has a plurality of game pieces and pair of dice. A method is disclosed for playing a plurality of games one a game board that includes a plurality of playing surfaces. The surfaces have intersecting columns and rows defining nine spots. One of the surfaces is on a top side of the board and a second surface is on a bottom side thereof. Players roll dice to determine who goes first. The dice have six sides numbered zero through five. Play continues until one player aligns three of their game pieces in a row, or the entire chosen surface is covered with game pieces. If neither player has three pieces aligned in a row, the player having the most pieces on the surface wins and gets to start the next game. Each of the players accumulates points during each round of play until one reaches a predetermined point total.

14 Claims, 3 Drawing Sheets

MULTI-GAME PLAYING SURFACE AND ASSOCIATED METHODS

CROSS REFERENCE TO RELATED APPLICATIONS

This application claims the benefit of U.S. Provisional Application No. 60/804,003, filed Jun. 6, 2006.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to board games and, more particularly, to a multi-game playing surface and associated methods for participating in a board game displayed on a double-sided game board having first and second playing surfaces for adults and children.

2. Prior Art

For centuries games have been a favorite pastime of adults as well as children. In fact, the earliest form of the familiar checkers can be traced to the Egyptians as early as 600 B.C. Other popular games, such as backgammon and chess, have also provided years of fun and excitement for families and friends. Traditional board, card, and trivia games continue to flourish, despite the foreboding in recent years that these would suffer in popularity from the onslaught of computer, video and hand-held forms of play. According to the NPD Group, which tracks retail sales for board games, sales were up 23% during the first 10 months of 2003, compared with the same period in 2002. Culture-watchers further stipulate that in these especially trying times, with terrorism looming and an uncertain economy, traditional games encourage relaxed, comfortable social interchange. Proving that nothing can equate the interaction of people in a common recreational pursuit, these tried-and-true diversions are certain to be around for a long time to come.

Prior art example shows many types of board games for playing Tic Tac Toe. Such board games are traditional in style and method and allow for two players to simultaneously play the game on a suitable board surface. Unfortunately, such board games are limited in that they allow only two people to play at a time and do not provide alternative playing scenarios beyond the traditional rules of Tic Tac Toe.

Accordingly, a need remains for a multi-game playing surface and associated methods in order to overcome the above-noted shortcomings. The present invention satisfies such a need by providing a method that is simple and easy to use, is lightweight yet durable in design, and offers consumers hours of competitive and challenging fun. Such a method conveniently provides players with a means of stimulating the mind and honing their thought processes. The method advantageously offers consumers a reprieve from the stresses of daily life, and effectively encourages positive social and family interaction through good-natured competition. The method can be easily carried in a purse, backpack or glove compartment, and can be enjoyed by children as well as adults. The method allows for more than two people to play at a time, and also allows for play using new and innovative rules.

BRIEF SUMMARY OF THE INVENTION

In view of the foregoing background, it is therefore an object of the present invention to provide a kit for a multi-game playing surface and associated methods. These and other objects, features, and advantages of the invention are provided by a multi-game playing surface and associated methods for participating in a board game displayed on a double-sided game board having first and second playing surfaces.

The board game has a plurality of game pieces and includes a method for playing the game. Such a method includes choosing one of the first and second playing surfaces to effectively play at least one of the board games thereon. Such each of the first and second playing surfaces conveniently has a plurality of intersecting columns and rows defining at least nine spots. A first one of the playing surfaces is conveniently displayed on a top side of the double-sided game board and a second one of the playing surfaces is conveniently displayed on a bottom side of the double-sided game board. A first and second one of the players rolls a first and second dice respectively. Such a one of the first and second players who advantageously rolls a highest value of the first and second dice gets to play first. The one player then simultaneously rolls the first and second dice. Such each of the first and second dice has six sides respectively numbered zero through five.

Each of the first and second players continues game play until one of the first and second players advantageously aligns three of the game pieces in a row, or the chosen playing surface is effectively fully covered with the game pieces. If neither of such first and second players has three of the game pieces advantageously aligned in a row, the one of the first and second players that effectively has a largest quantity of the game pieces on the chosen playing surface wins and gets to start the next game. Such first and second players may conveniently choose to roll the dice to effectively determine which one of the first and second players gets to start a subsequent game. Each of the first and second players continuously accumulates game points during each round of play until one of the first and second players advantageously reaches a predetermined point total.

In the first game, called Tic Tac Roll, the method includes assigning two points to one of the first and second players who is associated with advantageously aligning three of the game pieces in one row, thus effectively ending the game. If both of the first and second players fail to get three game pieces aligned in a row, such a method further includes assigning one point to one of the first and second players advantageously having the largest quantity of game pieces on the surface, thus effectively ending the game. The first of the first and second players to reach a total of seven points is the winner of the match.

If a sum of the first and second dice effectively falls within a numerical range of one through nine, then a first player advantageously places an associated game piece on one of the at least nine spots that has a value equal to the sum of the rolled dice, if and only if, the one spot is conveniently vacant. If such a sum equals zero, then a second player advantageously removes one of the game pieces of the first player from the chosen playing surface. If such a sum equals 10, the first player advantageously places one of the first player game pieces on any open one of the spots, or advantageously takes one of the game pieces of the second player from the chosen playing surface respectively. The first and second players skip a turn if the sum equals zero or ten during the round of play.

In the second game, called Advanced Tic Tac Roll, the method includes advantageously assigning a point value to a one of the first and second players effectively equal to a sum of the point values of a line conveniently defined by three linearly juxtaposed ones of the spots displayed on the chosen playing surface, thus effectively ending the game. If such of the first and second players fail to get three game pieces aligned in a row, such a method further includes assigning one point to one of the first and second players advantageously having the largest quantity of game pieces on the surface, thus effectively ending the game. The one of the players who effectively rolls a highest value on the first and second dice gets to advantageously start a next one of the games. The first of the first and second players to reach a total of thirty-three points is the winner of the match.

In the third game, called Gamble, the method further includes each of the first and second players continuously rolling the first and second dice seven times during a round of play. Such a one of the first and second players places an associated game piece on each of the spots that advantageously has an equal value to the sum of the first and second dice. If each of the players rolls a number which has been advantageously covered by the associated game pieces, then each of the players effectively removes the associated game pieces from the spot. After seven rolls, each of the first and second players effectively scores points for all lines of three spots that are covered by the associated game pieces. The first one of the first and second players that advantageously has a largest point total effectively wins the board game. If such first and second players have equal point totals, then each of the first and second players rolls one of the first and second dice wherein a highest value of the first and second dice effectively determines a winner of the board game.

In the fourth game, called Knockout, the method further includes rules a method substantially similar to Tic Tac Roll. If a one of the first and second players effectively rolls a sum of one through nine, an associated game piece is conveniently placed on the spot having the same sum. If an opponent game piece is effectively occupying the spot, it is advantageously 'knocked out' of the spot. Scoring is conveniently the same as Tic Tac Roll.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
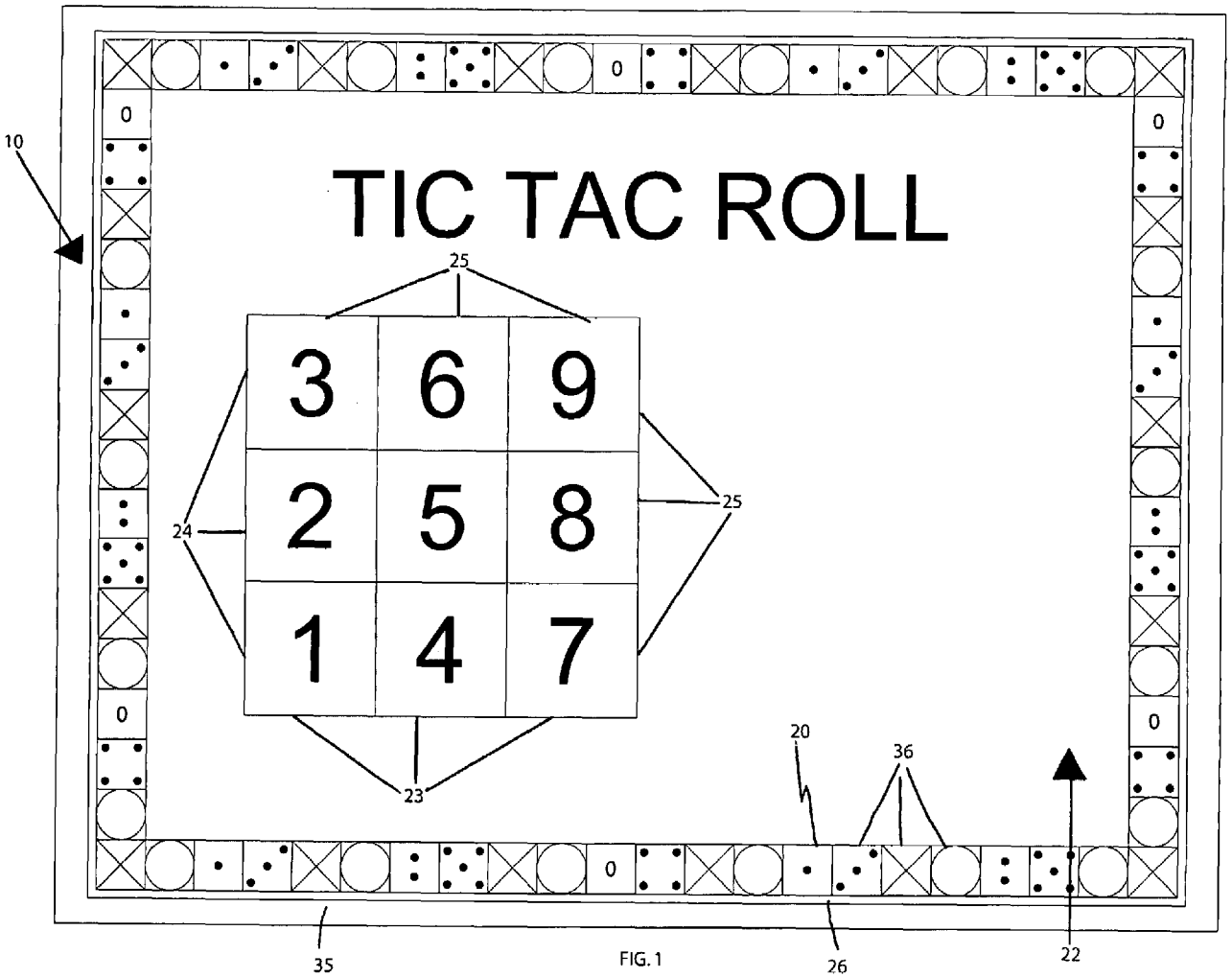
FIG. 1 is a top plan view of a multi-game playing surface and associated methods showing a surface for playing Tic Tac Roll and Knock-Off, in accordance with the present invention.
Figure 2:
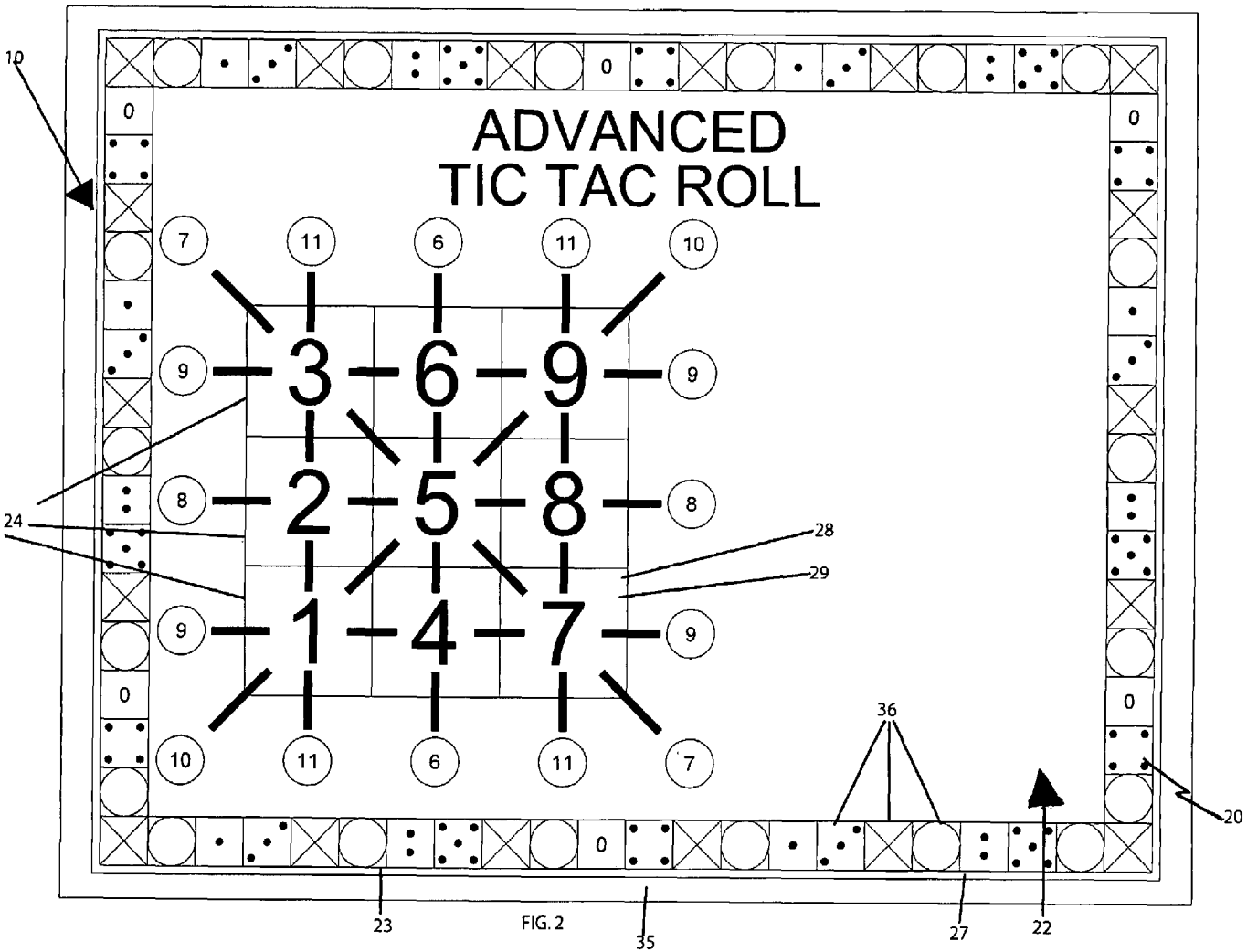
FIG. 2 is a top plan view of the apparatus shown in FIG. 1 showing a surface for playing Advanced Tic Tac Roll and Gamble.
Figure 3:
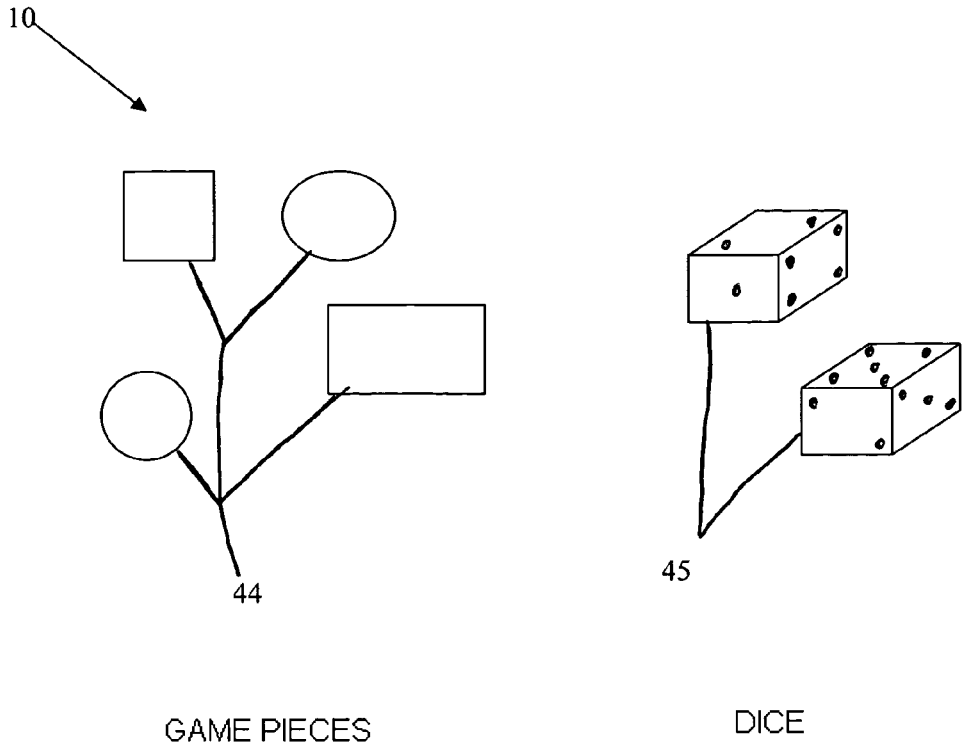
FIG. 3 illustrates sample game pieces and dice respectively.

The method of this invention is referred to generally in FIGS. 1-2 by the reference numeral 10 and is intended to provide a multi-game playing surface and associated methods. It should be understood that the game and associated method 10 may be used to play a variety of games by employing the playing surfaces and game board of the present invention and should not be limited in use to only those surfaces and board games described herein.

Referring initially to FIGS. 1 and 2, the present invention 10 has a plurality of game pieces 44 and includes a method for playing games. Of course, such game pieces 44 can be produced in a variety of shapes and sizes, as is obvious to a person of ordinary skill in the art. Such a method includes choosing one of first and second playing surfaces 21, 22, which is essential to effectively play at least one of the board games thereon. Such first 21 and second 22 playing surfaces conveniently has a plurality of intersecting columns 23 and rows 24 defining at least nine spots 25. Of course, such columns 23 and rows 24 can be produced in a variety of shapes and colors, as is obvious to a person of ordinary skill in the art.

A first one of the playing surfaces 21 is conveniently displayed on a top side 26 of the double-sided game board 20 and a second one 22 of the playing surfaces is conveniently displayed on a bottom side 27 of the double-sided game board 20, which is vital such that a user can determine which playing surface 21, 22 to use. Many players can play each game but for simplicity the following explanation of playing the games employs only two players for simplicity. For example, initially first and second players roll a first and second dice 45 respectively. The player who rolls a highest value of the first and second dice 45 gets to play first. Such a player then simultaneously rolls the first and second dice 45. In a preferred embodiment, each of the dice 45 has six sides respectively numbered zero through five. Of course, such dice 45 can be produced in a variety of colors, as is obvious to a person of ordinary skill in the art.

Each of the first and second players continues game play until one of the first and second players advantageously aligns three of the game pieces 44 in a single row 24 or single column 23, or the chosen playing surface 21, 22 is fully covered with the game pieces 44. If neither of the first and second players has three of the game pieces 44 advantageously aligned in a row 24 or column 23, then one of the first and second players that has a largest quantity of their game pieces 44 on the chosen playing surface 21, 22 wins and gets to start the next game. Each player may conveniently choose to roll the dice 45 to determine who gets to start a subsequent game. Each of the first and second players continuously accumulates game points during each round of play until one of the first and second players advantageously reaches a predetermined point total. In the Tic-Tac-Roll game, the predetermined point total equals 7 (as explained hereinbelow).

Referring to FIG. 1, in the first game, called Tic Tac Roll, the method 10 includes assigning two points to the player who aligns three of the game pieces 44 in one row 24 or column 23, which is essential for effectively ending the game. If both of the first and second players fail to get three game pieces 44 aligned in a row 24 or column 23, then one point gets awarded to the player who has the largest quantity of game pieces 44 on the surface 21, 22, which is essential for effectively ending the game. The first player to reach a total of seven points is the winner of the match.

When playing Tic-Tac-Roll and Advanced Tic-Tac-Roll, if a sum of the first and second dice 45 effectively falls within a numerical range of one through nine, then a first player advantageously places an associated game piece 44 on one of the at least nine spots 25 that has a value equal to the sum of the rolled dice 45, if and only if, spot 25 is vacant. If the dice 45 sum equals zero, then the second player advantageously removes one of the game pieces 44 of the first player from the chosen playing surface 21, 22. If such a sum equals 10, the first player advantageously places one of the first player game pieces 44 on any open one of the spots 25, or advantageously takes one of the game pieces 45 of the second player from the chosen playing surface 21, 22 respectively. Each player skips a turn if they roll a zero or ten during the round of play, which penalizes the players and allows play to effectively alternate between the first and second player respectively.

Referring to FIG. 2, in the second game, called Advanced Tic Tac Roll, the method 10 includes advantageously assigning a point value that equals a sum of the point values of a line conveniently defined by three linearly juxtaposed spots 25 displayed on the chosen playing surface 21, 22. Such a point value is assigned to the player who has aligned three game pieces 44 in a row 24 or column 23. If all players fail to get three game pieces 44 aligned in a row 24 or column 23, then one point is assigned to the player who advantageously has the largest quantity of game pieces 44 on the surface 21, 22, which is critical for effectively ending the game. The player who effectively rolls a highest value on the first and second dice 45 gets to advantageously start a next one of the games. The player to most quickly reach a total of thirty-three points is the winner of the match.

Again referring to FIG. 2, in the third game, called Gamble, the method 10 further includes each player continuously rolling the first and second dice 45 seven times during a round of play. Each player places an associated game piece 44 on each of the spots 25 that has an equal value to the sum of the first and second dice 45. If a player rolls a number which has been previously covered with their associated game pieces 44, then each player effectively removes their associated game pieces 44 from the spot 25. After seven rolls, the first and second players effectively score points for all lines of three spots 25 that are covered by the associated game pieces 44. The first player that advantageously has a largest point total effectively wins the match. If the first and second players have equal point totals, then each of the first and second players rolls one of the first and second dice 45, which is essential such that a highest value of the first and second dice 45 effectively determines a winner of the match.

Again referring to FIG. 1, in the fourth game, called Knockout, the method 10 further includes a step wherein each player rolls a sum of one through nine. An associated game piece 44 is conveniently placed on spot 25 having the same sum. If an opponent's game piece 44 already occupies spot 25, it is advantageously 'knocked out' of spot 25. Scoring is conveniently the same as Tic Tac Roll.

In operation, the method described of playing multiple games of the present invention is summarized hereinbelow. Appropriate for children as well as adults, the board game can advantageously be played by multiple players, allowing an entire family or group of friends to partake without leaving someone out. Designed to be played on any flat surface (such as the game board), surfaces 21, 22 and method 10 includes a playing board 20, a series of multi-colored game pieces 44, and a set of dice 45. Fabricated from durable cardboard or plastic material, the game board 20 has a substantially square shape. Of course, such a game board 20 can be produced from any suitable material and formed in a variety of shapes, as is obvious to a person of ordinary skill in the art.

The main area of the playing surface 21, 22 is centrally positioned on the game board and features nine numbered squares 28, configured in three rows 24 of three boxes 29 each. The top row contains the number 3, 6, 9; the center row contains the numbers 2, 5, 8; and the bottom row contains the numbers 1, 4, 7. These numbers appear in the same order as shown in FIGS. 1 and 2. Around the perimeter 35 of the board 20, a series of decorative squares 36 contain renderings of X's, O's, and die displays.

The dice 45 are similar to those commonly found in board games; two six-sided cubes each measuring approximately one-half inch in both height and width. One side of each die 45 includes the number "0", with the remaining dotted to designate the remaining numbers "1" through "5". The reverse side of the game board 20 further features an enhanced playing surface 21, 22 appropriate for an advanced version, as well as wager friendly version of the game. The simple design of the playing surface 21, 22 and dice game advantageously allows for the same to be packaged in an attractive cardboard box.

The method 10 and play of the game is very simple. First, players choose any flat surface for setup of the game, whether it is a table top, floor, or any other suitable surface. Next, all players roll the dice 45 to determine who goes first, with the highest number rolled as the deciding factor. The first player rolls the dice 45 again, and adds the numbers shown on each die 45 to determine the placement of their game piece 44 on the board 20. For example, if a first roll results in one die 45 displaying "5" and the other showing "4", the game piece 44 is placed on the number "9" square. In the event that the next player rolls a "9", their game piece 44 cannot be placed in this spot 25, as it is already occupied. Rolling two "0's" proves detrimental to a player, as this allows their opponent to remove any one of their game pieces 44, of his choosing, from the board 20.

However, if a player rolls a total of "10", the roller can either place one of his game pieces 44 on any open spot 25 or simply take off one of his opponent's game pieces 44 already on the board 20. Play continues in this manner until one of two things happens: one player gets three game pieces 44 aligned in a vertical, horizontal, or diagonal row 24 (scoring two points), or the board 20 is full with no defined rows 24 being formed by any one player. In the case of the latter event, the player with the most game pieces 44 on the board 20 scores one point and gets to start the next game. After every game won by three in a row 24, the players roll high dice 45 again to determine who starts next. Points are continuously accumulated until a player reaches seven points, determining the winner of the match.

Combining two playing surfaces 21, 22 into one multi-game board 20 effectively increases the number of ways that a traditional game of Tic Tac Toe can be played, thereby providing an unexpected benefit and overcoming prior art shortcomings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A method for participating in a board game displayed on a double-sided game board having first and second playing surfaces, said board game including a plurality of game pieces, said method comprising:

a) choosing one of said first and second playing surfaces to play at least one of said board games thereon, each of said first and second playing surfaces having a plurality of intersecting columns and rows defining at least nine spots;

b) first and second ones of said players rolling a first and second dice respectively, wherein one of said first and second players who rolls a highest value of said first and second dice gets to play first;

c) wherein said one player simultaneously rolls said first and second dice, each of said first and second dice having six sides respectively numbered zero through five;

d) if a sum of said first and second dice has a total value between one and nine, said one player placing an associated one of said game pieces on one of said nine spots having a value equal to said sum;

e) if a sum of said first and second dice has a total value greater than nine, said one player placing said associated game piece on any open spot of said nine spots;

f) continuing game play until one event occurs selected from the group of events including i) one of said first and second players aligns three of said game pieces in a row, and ii) said chosen playing surface is fully covered with said game pieces;

g) if neither of said first and second players has three of said game pieces aligned in a row, one of said first and second players having a largest quantity of said game pieces on said chosen playing surface wins a first predetermined point quantity and gets to start a next game;

h) assigning a second predetermined point quantity after a game is won by aligning three of said game pieces in a row;

i) rolling said dice to determine which one of said first and second players gets to start a subsequent game;

j) each of said first and second players continuously accumulating game points during each round of play until one of said first and second players reaches a predetermined point total;

wherein if a sum of said first and second dice falls within a numerical range of one through nine, then step d) further includes the steps of:

i. a first player placing an associated game piece on one of said at least nine spots that has a value equal to said sum if and only if said one spot is vacant;

ii. if said sum equals zero, then a second player removes one of said game pieces of said first player off said chosen playing surface;

iii. if said sum equals 10, said first player executing one step selected from the group consisting of:

1. placing one of said first player game pieces on any open one of said spots, and 2. taking one of said game pieces of said second player respectively;

wherein said first and second players skip a turn if said sum equals zero or ten during said round of play.

2. The method of claim 1, wherein step d) further comprises:

i. assigning two points to one of said first and second players who is associated with said one event.

3. The method of claim 1, wherein said first predetermined point quantity equals seven points.

4. The method of claim 1, wherein said second predetermined point quantity equals one point.

5. The method of claim 1, wherein said first predetermined point quantity equals a sum of the point values of a line defined by three linearly juxtaposed ones of said spots displayed on said chosen playing surface, wherein one of said players who rolls a highest value on said first and second dice gets to start a next one of said games.

6. The method of claim 1, wherein a winning one of said players is determined when one of said first and second players accumulates thirty-three points.

7. The method of claim 1, wherein said second predetermined point quantity equals one point.

8. A method for participating in a board game displayed on a double-sided game board having first and second playing surfaces, said board game including a plurality of game pieces, said method comprising:

a. choosing one of said first and second playing surfaces to play at least one of said board games thereon, each of said first and second playing surfaces having a plurality of intersecting columns and rows defining at least nine spots, wherein a first one of said playing surfaces is displayed on a top side of said double-sided game board and a second one of said playing surface is displayed on a bottom side of said double-sided game board;

b. first and second ones of said players rolling a first and second dice respectively, wherein one of said first and second players who rolls a highest value of said first and second dice gets to play first;

c. wherein said one player simultaneously rolls said first and second dice, each of said first and second dice having six sides respectively numbered zero through five;

d. if a sum of said first and second dice has a total value between one and nine, said one player placing an associated one of said game pieces on one of said nine spots having a value equal to said sum;

e. if a sum of said first and second dice has a total value greater than nine, said one player placing said associated game piece on any open spot of said nine spots;

f. continuing game play until one event occurs selected from the group of events including i) one of said first and second players aligns three of said game pieces in a row, and ii) said chosen playing surface is fully covered with said game pieces;

g. if neither of said first and second players has three of said game pieces aligned in a row, one of said first and second players having a largest quantity of said game pieces on said chosen playing surface wins a first predetermined point quantity and gets to start a next game;

h. assigning a second predetermined point quantity after a game is won by aligning three of said game pieces in a row;

i. rolling said dice to determine which one of said first and second players gets to start a subsequent game;

j. each of said first and second players continuously accumulating game points during each round of play until one of said first and second players reaches a predetermined point total;

wherein if a sum of said first and second dice falls within a numerical range of one through nine, then step d) further includes the steps of:

i. a first player placing an associated game piece on one of said at least nine spots that has a value equal to said sum if and only if said one spot is vacant;

ii. if said sum equals zero, then a second player removes one of said game pieces of said first player off said chosen playing surface;

iii. if said sum equals 10, said first player executing one step selected from the group consisting of:

1. placing one of said first player game pieces on any open one of said spots, and 2. taking one of said game nieces of said second player respectively;

wherein said first and second players skip a turn if said sum equals zero or ten during said round of play.

9. The method of claim 8, wherein step d) further comprises:

i. assigning two points to one of said first and second players who is associated with said one event.

10. The method of claim 8, wherein said first predetermined point quantity equals seven points.

11. The method of claim 8, wherein said second predetermined point quantity equals one point.

12. The method of claim 8, wherein said first predetermined point quantity equals a sum of the point values of a line defined by three linearly juxtaposed ones of said spots displayed on said chosen playing surface, wherein one of said players who rolls a highest value on said first and second dice gets to start a next one of said games.

13. The method of claim 8, wherein a winning one of said players is determined when one of said first and second players accumulates thirty-three points.

14. The method of claim 8, wherein said second predetermined point quantity equals one point.

* * * * *